United States Patent [19]

Livick

[11] 4,216,613

[45] Aug. 12, 1980

[54] TOY SPACE SHIP AND REMOVABLE FIGHTER AIRPLANE

[76] Inventor: Lester R. Livick, 15106 Beatty St., San Leandro, Calif. 94579

[21] Appl. No.: 963,088

[22] Filed: Nov. 22, 1978

[51] Int. Cl.[2] ..... A63H 11/10

[52] U.S. Cl. ..... 46/202; 46/76 R

[58] Field of Search ..... 46/202, 201, 1 H, 77, 46/76 R, 74 R, 111, 112

[56] References Cited

U.S. PATENT DOCUMENTS

| | | | |
|---|---|---|---|
| 2,825,181 | 3/1958 | Gunderson | 46/76 R X |
| 2,876,677 | 3/1959 | Clark et al. | 46/76 R |
| 3,083,019 | 3/1963 | Giuliano | 46/76 R X |

FOREIGN PATENT DOCUMENTS

| | | | |
|---|---|---|---|
| 239399 | 9/1925 | United Kingdom | 46/76 R |

*Primary Examiner*—Louis G. Mancene
*Assistant Examiner*—Mickey Yu
*Attorney, Agent, or Firm*—Alvin E. Hendricson; William R. Piper

[57] ABSTRACT

A toy aircraft fighter including a space craft removably supported by a manually actuated turntable and in turn supporting a fighter airplane that may be removed from the space craft. A transparent landing apparatus for the space craft has movable elevator enclosed in an elevator shaft and a string is connected to the elevator to permit it to be manually raised and the elevator moves downwardly by gravity. A pivoted ramp is positioned at the bottom of the elevator shaft with suitable cables being provided for swinging the ramp from operative to inoperative position.

2 Claims, 6 Drawing Figures

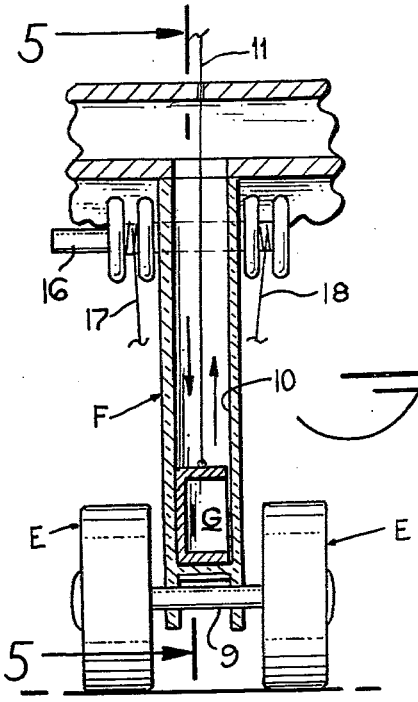
FIG. 3
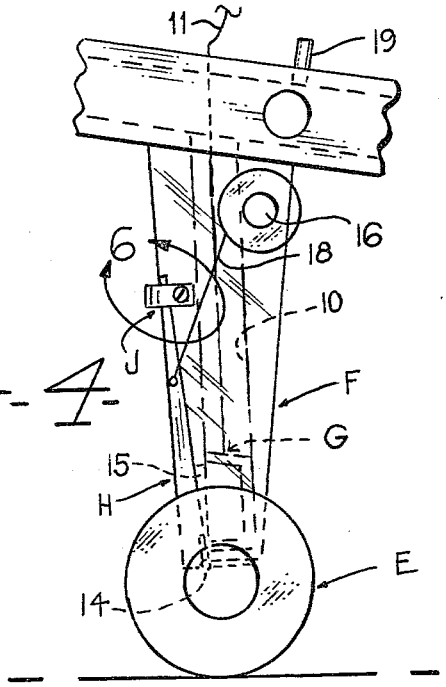
FIG. 4
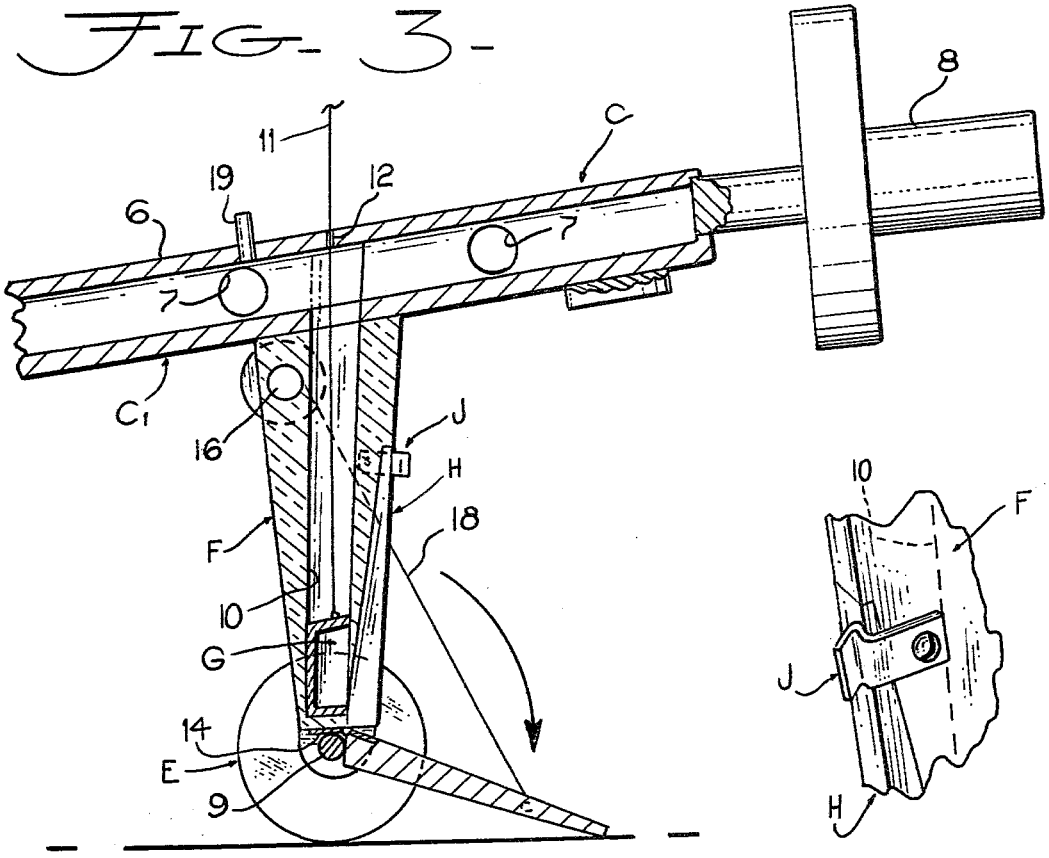
FIG. 5
FIG. 6

TOY SPACE SHIP AND REMOVABLE FIGHTER AIRPLANE

SUMMARY OF THE INVENTION

An object of my invention is to provide a toy space craft that is normally suspended from a turntable which the child may manually revolve. The space craft may be removed from the turntable and it removably supports a fighter. In addition, the landing apparatus for the space craft has a transparent elevator well with an elevator slidable therein and activated by the child pulling on a string connected to the elevator. A pivoted ramp is positioned at the bottom of the elevator well and when swung into operative position it will uncover an opening in the elevator shaft giving access to the elevator. Novel means is used for swinging the ramp from operative to inoperative or closed position and this will close the entrance to the elevator shaft. A resilient catch will yieldingly hold the ramp closed.

BRIEF DESCRIPTION OF THE DRAWINGS

FIG. 3 is an enlarged vertical section taken along the line 3—3 of FIG. 2 and illustrates the transparent elevator shaft which forms a part of the landing gear for the space craft. An elevator is slidably mounted in the elevator well and a string is connected to the elevator and may be pulled by the child for raising the elevator.

FIG. 4 is a side elevation of the space craft landing gear when looking in the direction of the arrows 4—4 of FIG. 3.

FIG. 5 is a section along the line 5—5 of FIG. 3 and shows the pivoted ramp in operative position with the opening to the elevator being uncovered.

FIG. 6 is an enlarged perspective view of the circled portion 6 shown in FIG. 4. A resilient catch is shown yieldingly holding the ramp in inoperative position.

DESCRIPTION OF THE PREFERRED EMBODIMENT

Figure 1:
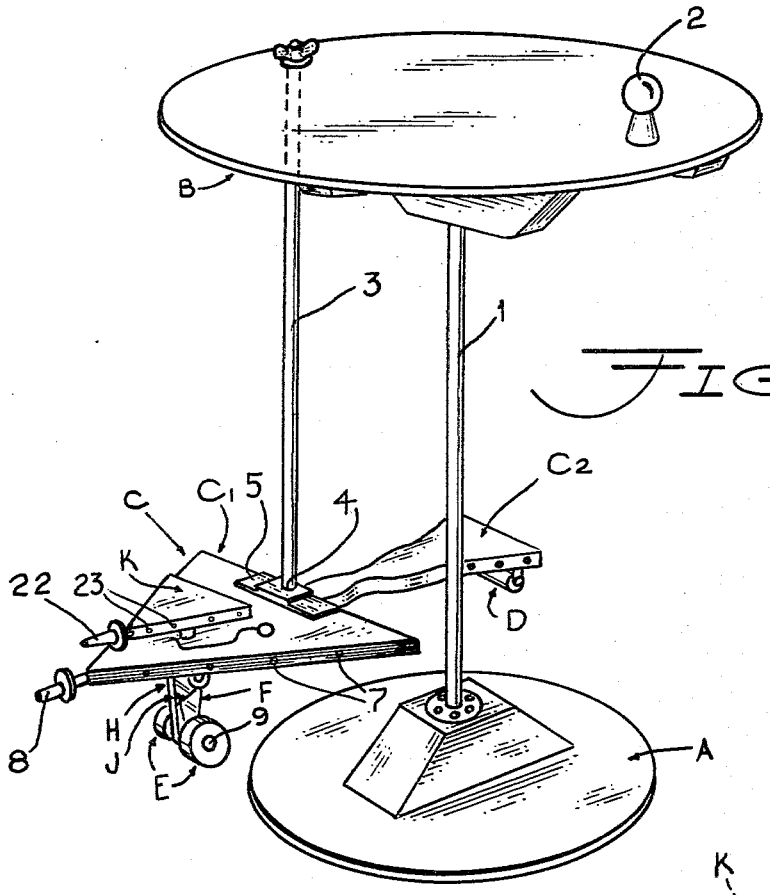
FIG. 1 is a perspective view of the toy space craft being supported by a turntable.

In carrying out my invention, I show in FIG. 1, a base A supporting an upright member 1 on which a turntable B, is rotatably supported and which may be rotated by a handle 2. A support rod 3 depends from the turntable and its lower end is threaded and is removably received in a threaded bore 4 provided in a bracket 5 secured to a space craft C, see FIGS. 1 and 2. The space craft is shown separated from the turntable in FIG. 2 and certain novel features of the space craft are shown in detail in FIGS. 3 to 6, inclusive.

FIGS. 3 and 5 show the body 6 of the space craft toy C, as being hollow, the theory being that miniature people, not shown, occupy this space and have access to guns indicated by circles 7 along the sides of the main triangular body $C^1$, and along the sides of the hollow tail $C^2$. A gun 8 is mounted at the front of the space craft toy C.

The toy space craft has a rear wheel D, and a front pair of wheels E for a child to roll the space craft over the floor. FIG. 5 shows the front wheels E connected by an axle 9 that in turn is connected to a transparent undercarriage F for the body 6 of the space craft. The reason for the undercarriage being transparent is so that the child can see a miniature elevator G that can slide vertically in an elevator well or shaft 10, see FIG. 5. A string 11 is connected to the top of the elevator and extends upwardly in the elevator shaft 10 and through an opening 12 in the body 6 of the space craft C and has a ring 13 at its outer end by means of which the child may raise and lower the elevator. FIG. 5 shows in dot-dash lines how the elevator may be raised into the interior of the hollow body 6 to receive or discharge make-believe persons.

A swingable ramp H, is hingedly connected to the bottom of the undercarriage F, at 14, see FIGS. 4 and 5, and may be swung from operative position into inoperative position as shown in FIG. 6, so as to close an opening 15 in the undercarriage that gives access to the elevator G, when the latter is in its lowest position. I show a ramp raising apparatus in FIGS. 3 and 4. A shaft 16 is rotatably mounted in the undercarriage F, see also FIG. 5 and the ends of the shaft project beyong the sides of the undercarriage. Two cables 17 and 18 have their ends wrapped around the exposed shaft end and the opposite ends of the cables are connected to the swingable ramp H. When the shaft 16 is manually rotated in one direction it will wind up the two cables and swing the ramp H into inoperative position which will also close the opening 15 in the undercarriage F. A resilient catch J, see FIG. 6, yieldingly holds the ramp in closed position.

Figure 2:
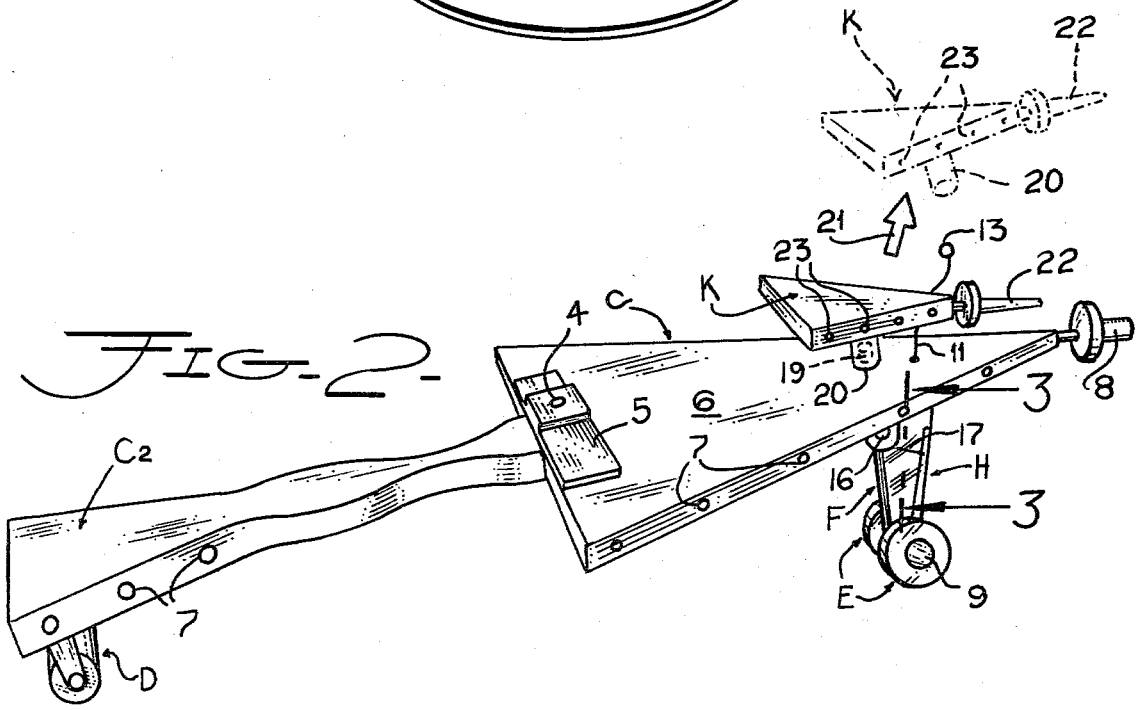
FIG. 2 is a perspective view of the space craft shown on an enlarged scale. The fighter aircraft is shown removably attached to the space craft and by dot-dash lines shown removed from the space craft ready for independent flight supported by the child's hand, not shown.

Referring to FIGS. 1 and 2, it will be seen that I show a toy fighter airplane K, removably mounted on the top of the space craft body 6 and in FIG. 2 the fighter is shown in a theoretical flight by dot-dash lines which the child controls after removing it from the space craft C. The body 6 has a pin 19 projecting thereabove, see also FIGS. 4 and 5, and the toy fighter K, has a tubular member 20, depending from its underside and adapted to be removably mounted on the pin. The arrow 21, in FIG. 2, illustrates how the child can remove the toy fighter K from the space craft C, and conduct it in a simulated flight. The toy fighter has a gun 22 at its forward end and the circles 23 in its sides may represent additional guns.

The child may attach the fighter K to the space craft C and may also attach the space craft to the support 3 which connects it to the turntable. The turntable may now be rotated by the handle 2 so as to swing the space craft with its toy fighter K, around the upright 1. Then the child can free the space craft from its support 3 and roll the craft over the floor on its wheels D and E. The ramp H may be swung into operative position and the child may raise and lower the elevator G, by manipulating the string 11 and watching the movement of the elevator through the transparent undercarriage F.

It is also possible for the child to move the space craft C with its toy fighter through the air by hand to simulate flight and then the fighter K may be removed from the space craft to simulate independent flight from its space craft.

I claim:

1. A toy space craft with a hollow body and a transparent undercarriage with wheels for supporting the body when the latter is moved over the ground;

(a) said undercarriage having an elevator shaft in its interior that communicates at its top with the interior of said body and has an opening at its bottom;

(b) an elevator slidably mounted in said shaft and having a string connected to the top of the elevator and extending through the top of the body for permitting the raising and lowering of the elevator in the shaft;

(c) a ramp hingedly connected to the bottom of said undercarriage and swingable from operative position into an inoperative position for closing the opening at the bottom of the elevator shaft; and (d) means for swinging said ramp from operative to an inoperative position where it will close the bottom opening to the elevator shaft.

2. The combination as set forth in claim 1: and in which (a) a resilient catch on said undercarriage will removably secure the ramp in closed position when said means is actuated for swinging the ramp into closed position.

* * * * *